US006347972B1

(12) United States Patent
Gormley et al.

(10) Patent No.: US 6,347,972 B1
(45) Date of Patent: Feb. 19, 2002

(54) SHUTTLE WHEEL TOY

(75) Inventors: Jason Gormley; Justine Gormley, both of Oshawa (CA)

(73) Assignee: Paid to Play Inc., NewMarket (CA)

( * ) Notice: Subject to any disclaimer, the term of this patent is extended or adjusted under 35 U.S.C. 154(b) by 0 days.

(21) Appl. No.: 09/488,853

(22) Filed: Jan. 21, 2000

(51) Int. Cl.[7] ..... A63H 33/26

(52) U.S. Cl. ..... 446/138; 446/450; 446/441; 446/447

(58) Field of Search ..... 273/440, 441, 273/109; 446/137, 138, 132, 129, 133, 421, 444, 445, 450

(56) References Cited

U.S. PATENT DOCUMENTS

| | | | | | |
|---|---|---|---|---|---|
| 1,005,853 | A | * | 10/1911 | Lewis | 446/132 |
| 3,218,074 | A | * | 11/1965 | Miller | 273/109 |
| 3,466,796 | A | * | 9/1969 | Greenblatt | 446/132 |
| 3,593,999 | A | * | 7/1971 | Kirk | 273/109 |
| 4,018,444 | A | * | 4/1977 | Chew, Jr. et al. | 273/109 |
| 4,031,660 | A | * | 6/1977 | Chen | 446/138 |
| 4,501,568 | A | * | 2/1985 | Nagaoka | 446/438 |
| 4,531,923 | A | * | 7/1985 | Lohr | 446/138 |
| 5,292,124 | A | * | 3/1994 | Carpenter | 273/440 |

* cited by examiner

*Primary Examiner*—Jacob K. Ackun, Jr.
*Assistant Examiner*—Urszula M. Cegielnik

(57) ABSTRACT

A hand held shuttle wheel toy is provided having parallel metal rails on which a shuttle wheel can be rolled back and forth. The toy comprises a first pair of parallel metal rails, each of said rails having a top and bottom side, a fixed end and at least one free end; a handle into which the fixed end of said rails in inserted; a shuttle wheel having a magnetic core, a conical projection at each end of the magnetic core, a central hub wherein said core is inserted into said hub with the conical projections extending co-axially out from said central hub and a circular rim having an inner surface and an outer surface; a second pair of parallel metal rails, each of said rails having a top and bottom side, a first end fixed within said handle and a second end remote from said handle wherein the second pair of rails are bent upwards adjacent the handle so as to run back at an incline above the handle; opposite outward V-shaped curves in each of said rails adjacent said handle and wherein the free end of said rails is bent outwardly to permit said shuttle wheel to roll along the top side of each rail and then reverse direction on the bottom side of each rail. If properly handled, the wheel can be moved along the rails which provide a simple path for the wheel to follow. Once one is adept at maintaining the simple motion of the wheel a wide variety of tricks can be performed.

6 Claims, 4 Drawing Sheets

SHUTTLE WHEEL TOY

BACKGROUND OF THE INVENTION

1. Field of the Invention

This invention relates to a hand held shuttle wheel toy on which a spinning wheel is moved along a pair of rails. In particular the present invention provides a toy which by flicking the wrist or finger tapping the rails the wheel can be caused to perform a multitude of tricks.

2. Description of the Prior Art

Hand held shuttle wheel toys having a pair of parallel U-shaped rails on which a shuttle wheel equipped with a magnetic shaft and which can be rolled back and forth on the rails are known. One end of the rails are typically embedded in a handle and the free end of each rail bent to extend outwardly. A portion of each rail adjacent the handle is also bent outwardly to form a V-shape curve. The outwardly bent free end and V-shape curve permit the wheel to roll continuously along the top of each rail and then reverse direction on the bottom of each rail.

A variety of improvements have been proposed to the basic toy to improve its playability. U.S. Pat. No. 4,031,660 is directed to a method of illuminating the wheel to provide greater enjoyment. Similarly U.S. Pat. No. 4,501,568 is directed to illuminating the wheel to provide visual variations. U.S. Pat. No. 4,531,923 provides a spinning element having two wheels joined by a magnetized axle which rotates along a single flat elongated wand. Canadian Patent No. 2,169, 154 is directed to an improved design for the shuttle wheel.

All of the prior art toys are directed to the simple movement of the wheel back and forth along the rails and provide limited play value.

The present inventors have adapted the basic structure of the prior art toys to enable the performance of a multitude of tricks by flicking the wrist or finger tapping the rails where the wheel is either launched into the air, roll on one of the upper and one of the lower rails at the same time, spin on table tops or remain on the rails while the toy is flipped in the air. Once the simple motion is mastered by the user it becomes a starting point to execute the countless tricks and maneuvers. These tricks will, in conjunction with, increased durability, and visual attractiveness, ensure that a child does not soon become bored.

SUMMARY OF THE INVENTION

It is an object of the invention to provide a design so that once the simple motion is mastered by the user it becomes a starting point to execute countless tricks and maneuvers. These tricks will, in conjunction with, increased durability, and visual attractiveness, ensure that a child does not soon become bored.

Thus in accordance with the present invention there is provided a hand held shuttle wheel toy having parallel metal rails on which a shuttle wheel can be rolled back and forth, said toy comprising:

(a) a pair of parallel generally U-shaped metal rails, each of said rails having a top and bottom side, a fixed end and at least one free end;

(b) a handle into which the fixed end of said rails in inserted;

(c) a shuttle wheel having a magnetic core, a conical projection at each end of the magnetic core, a central hub wherein said core is inserted into said hub with the conical projections extending co-axially out from said central hub and a circular rim having an inner surface and an outer surface;

(d) opposite outward V-shaped curves in each of said rails adjacent said handle and wherein the free end of said rails is bent outwardly to permit said shuttle wheel to roll along the top side of each rail and then reverse direction on the bottom side of each rail.

(e) a second pair of parallel metal rails, each of said rails having a top and bottom side, a first end fixed within said handle and a second end remote from said handle, wherein the second pair of rails are bent upwards adjacent the handle so as to run back at an incline above the handle; and (f) opposite outward V-shaped curves in each of said second pair of rails adjacent said handle and wherein the second end of said rails is bent outwardly to permit said shuttle wheel to roll along the top side of each of said second pair of rails and then reverse direction on the bottom side of each of said second pair of rails.

The shuttle wheel for use with the hand held shuttle wheel toy of the present invention preferably comprises: (1) a magnetic core (2) a conical projection at each end of the magnetic core (2) a central hub wherein said core is inserted into said hub with the conical projections extending co-axially out from said central hub and (3) a circular rim having an inner surface and an outer surface The present invention can be used to perform tricks by tilting the shuttle wheel toy forwards and backwards to cause said shuttle wheel to roll back and forth along said rails, then performing an action selected from the group consisting of flicking the wrist, finger tapping the rails or wheel, depressing the free end of said rails or separating said rails thereby causing the shuttle wheel or shuttle toy to perform a trick selected from the group consisting of the shuttle wheel to be launched into the air, one end of the shuttle wheel to roll on the top section of one rail and the other end on the bottom section of the other rail, causing the wheel to spin on a hard surface or the toy to be flipped in the air with the shuttle wheel continuing to roll on the rails.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
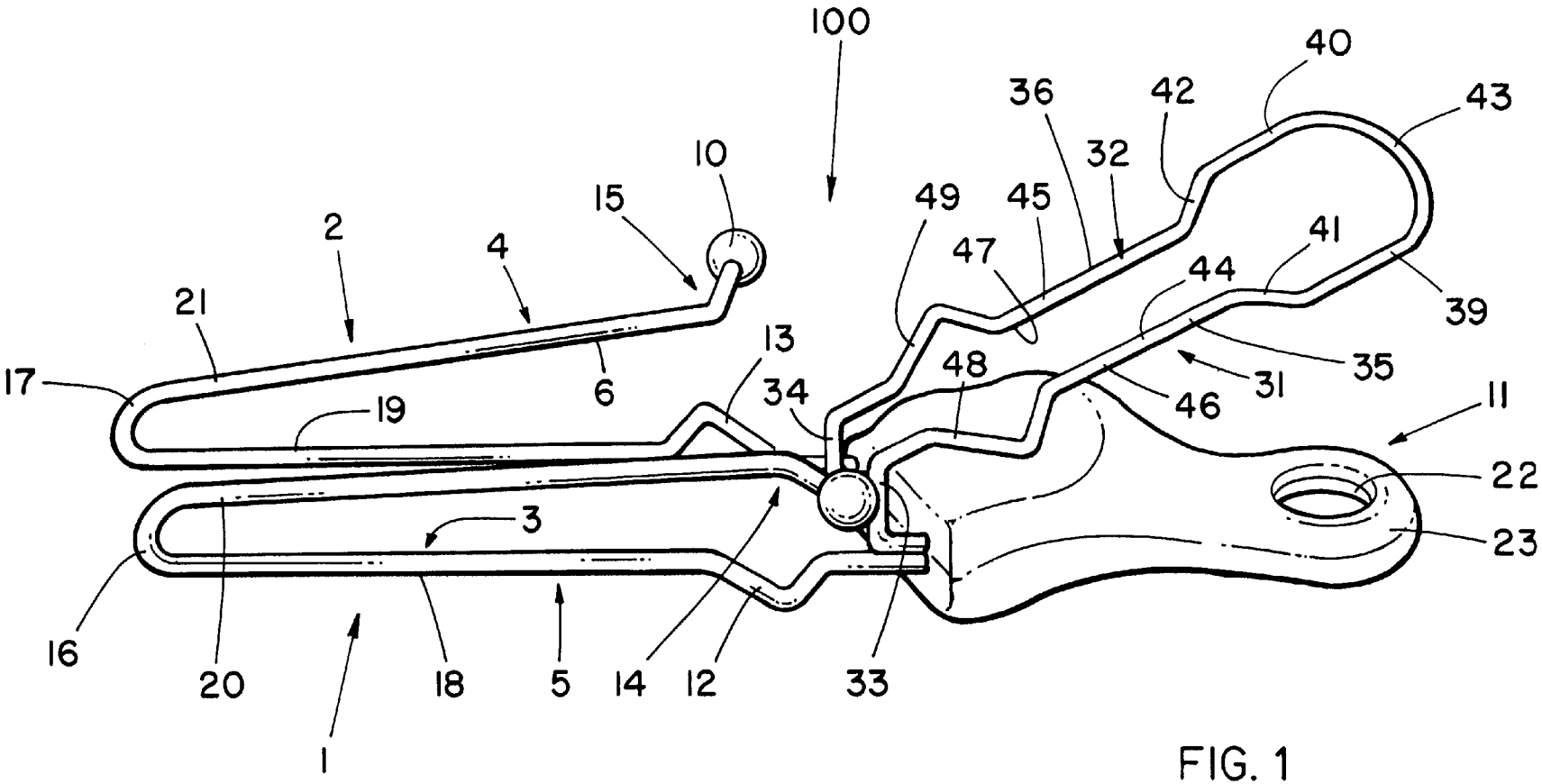
FIG. 1 is a perspective assembly view, illustrating a hand held shuttle wheel toy according to an embodiment of the present invention.

Referring to FIGS. 1 to 4 a hand held shuttle wheel toy having parallel metal rails on which a shuttle wheel can be rolled back and forth according to the present invention is generally indicated at 100. The shuttle wheel toy 100 consists of a pair of parallel metal rails 1, 2, each of said rails 1 and 2 having a top 3, 4 and bottom side 5, 6 respectively. Each of the rails 1, 2 has a fixed end 7, 8 (FIG. 2) and at least one free end 9, 10. A handle 11 is provided into which the fixed end 7, 8 of the rails 1, 2 is inserted. Opposite outward V-shaped curves 12, 13 are located in each of the rails 1, 2 adjacent the handle 11. The free end(s) 9, 10 of the rails 1, 2 is bent outwardly to form an angular section 14, 15 termed ollie pegs by the present inventors. The combination of the V-shaped curves 12, 13 and ollie pegs 14, 15 permits a shuttle wheel to roll along the top side 3, 4 of each rail 1, 2 and then reverse direction on the bottom side 5, 6 of each rail.

The rails 1, 2 can take a variety of different shapes so long as they remain substantially parallel. In FIGS. 1 to 4 the rails 1, 2 are generally U-shaped and run parallel to one another out from the handle 11. A hole 22 is provided in the handle at the end 23 remote from the rails. The inclusion of the hole 22 permits a variety of unique and different tricks to be performed. Hole 22 can be either provided in the top surface of handle 11 or through the side of the handle. The handle is ergonomically formed to fit comfortably within the players hand and provide easy of use without strain on the players wrist. The rails 1, 2 are bent upwards halfway along their length in U bends 16, 17 so as to run back towards the handle 11 forming a bottom rail section 18, 19 and a top rail section 20, 21 for each of the rails 1, 2 respectively. The rails 1, 2 each terminate as noted above at ollie pegs 14, 15 directly above the aforementioned opposite outward V-shaped curves 12, 13 located in each of the rails 1, 2 adjacent the handle 11.

A second set of parallel rails 31, 32 run parallel to one another out from the handle 11. The rails 31, 32 are bent upwards adjacent the handle 11 in bends 33, 34 so as to run back at an incline above the handle 11 forming a top rail section 35, 36 for each of the rails 31, 32 respectively. The rails 31, 32 each as noted above have a first end 37, 38 welded to the rails 1, 2 within said handle 11. A second end 39, 40 of said rails 31, 32 is bent outwardly at sections 41, 42 and then join together in loop 43 to permit a shuttle wheel to roll along the top side 44, 45 of each of said second pair of rails 31, 32 and then reverse direction on the bottom side 46, 47 of each of said second pair of rails 31, 32. Opposite outward V-shaped curves 48, 49 are located in each of the rails 31, 32 adjacent the bends 33, 34. The V-shaped curves 48, 49 permit a shuttle wheel to roll along the top side 44, 45 of each rail 31, 32 and then reverse direction on the bottom side 46, 47 of each rail.

In the preferred embodiment the rails are formed of 0.125 OD steel cold formed with rails 1, 2 and 31, 32 resistance welded at points 20 in said handle. The handle 11 is preferably ergonomically styled to permit use by either the left or right hand.

Figure 2:
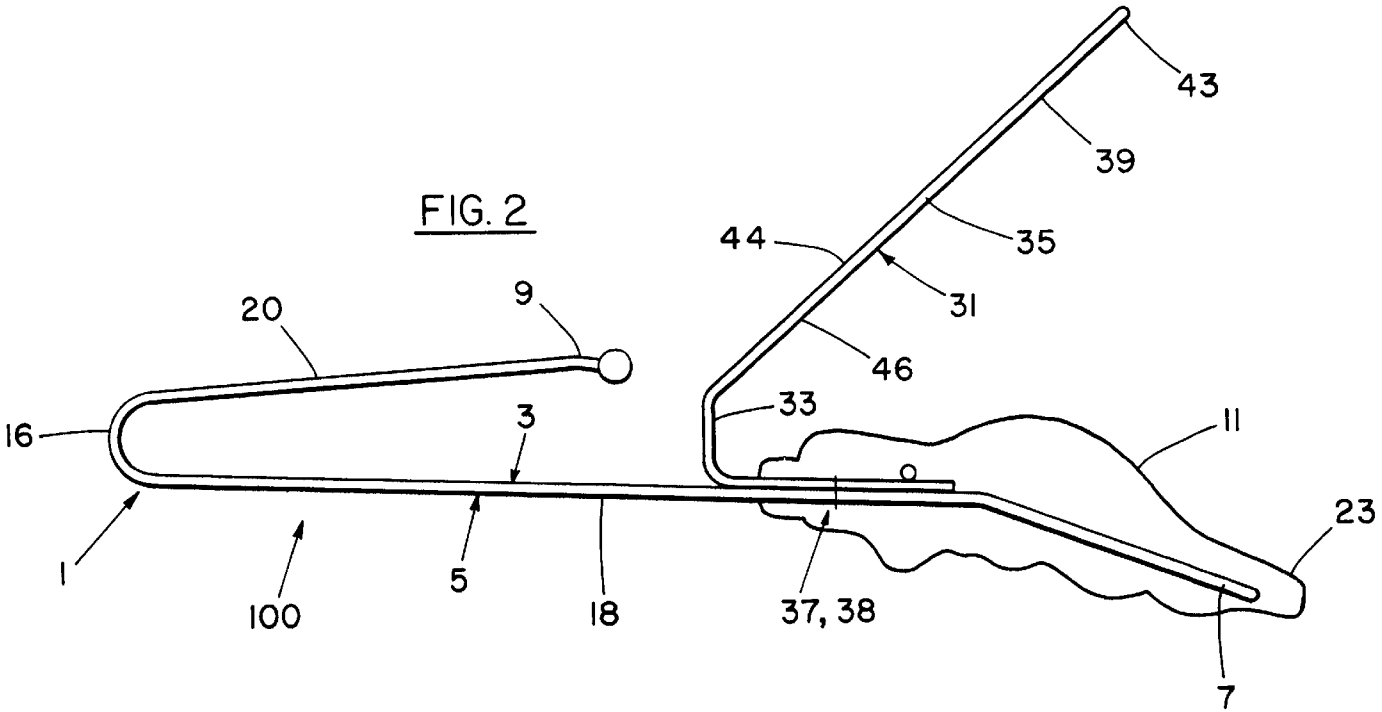
FIG. 2 is a side plan view partially in cross section of the hand held shuttle wheel toy of FIG. 1.
Figure 3:
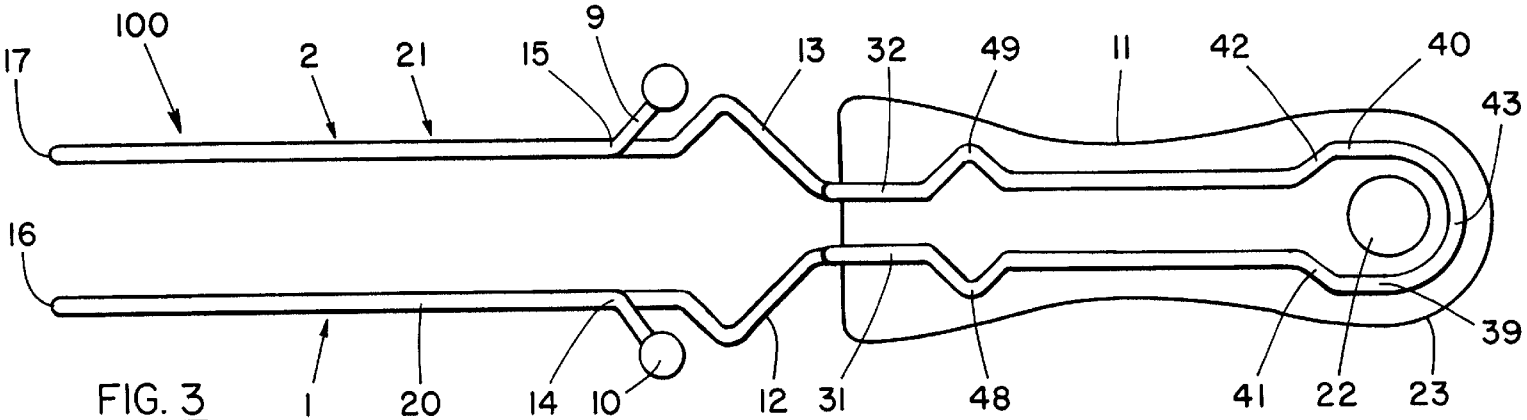
FIG. 3 is a top plan view of the toy of FIG. 2.
Figure 4:
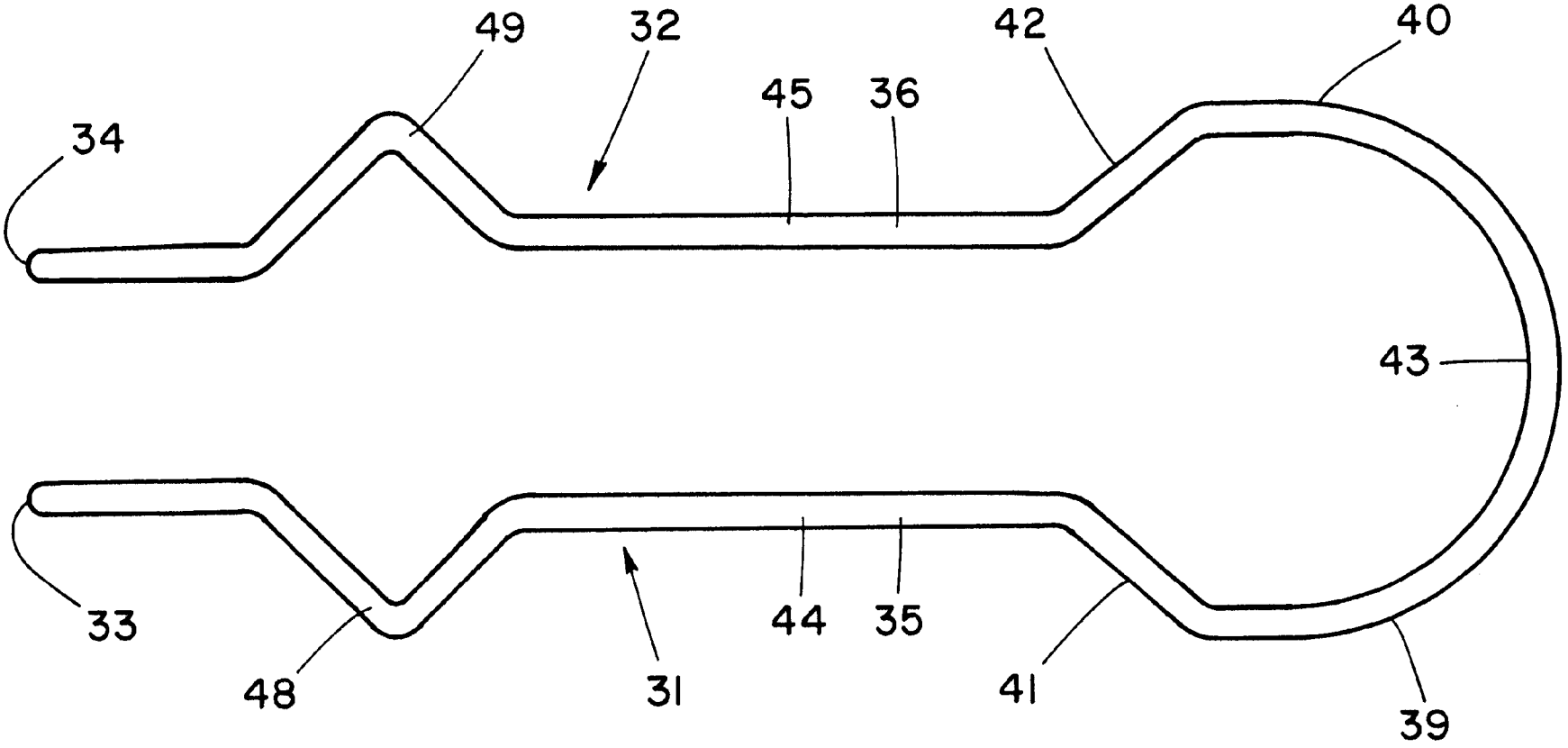
FIG. 4 is a top plan view of the second pair of rails of the toy in FIG. 2.
Figure 5:
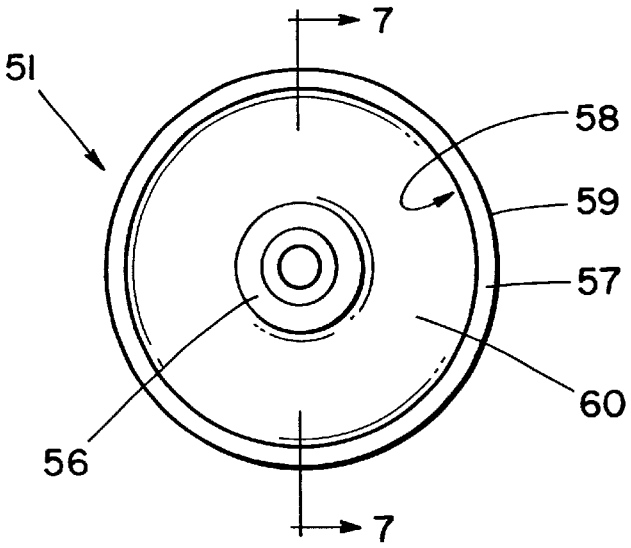
FIG. 5 is a side plan view of a shuttle wheel for use with the toy of FIG. 1.
Figure 6:
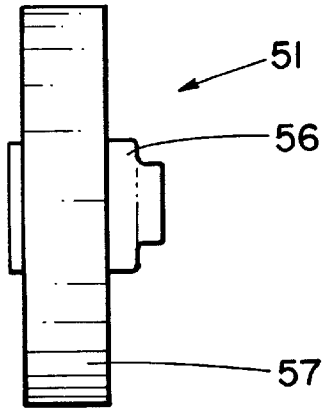
FIG. 6 is an end view of the shuttle wheel of FIG. 5.
Figure 8:
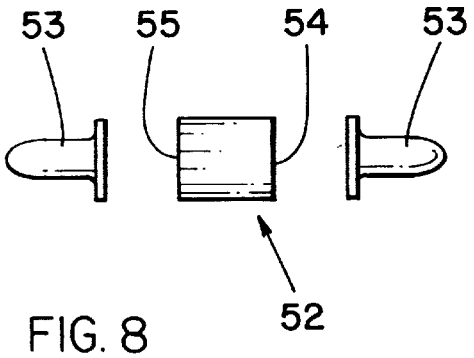
FIG. 8 is an exploded plan view of the magnet and conical projections of the wheel of FIG. 5.
Figure 7:
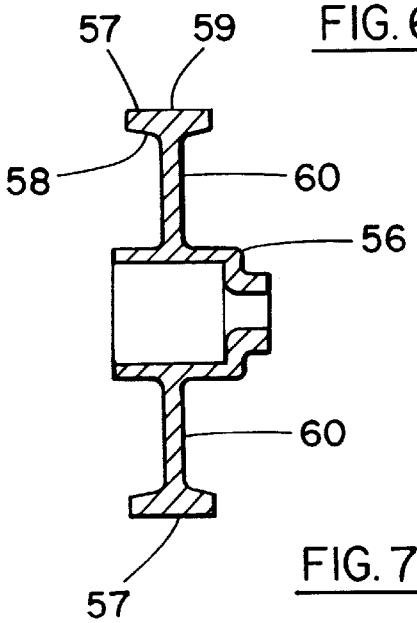
FIG. 7 is a cross section along line 7—7 in FIG. 5, less hub and magnet.
Figure 9:
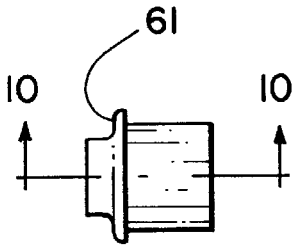
FIG. 9 is a side plan view of the hub of the wheel of FIG. 5.
Figure 10:
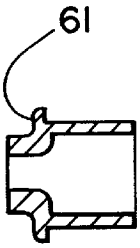
FIG. 10 is a cross section of the hub of FIG. 9 along lines 10—10.

FIGS. 5 to 10 illustrate a shuttle wheel for use with the embodiment of present invention shown in FIG. 2. The shuttle wheel for use with a hand held shuttle wheel toy having parallel metal rails on which said shuttle wheel can be rolled back and forth, is generally indicated at 51. The shuttle wheel 51 consists of a magnetic core 52, preferably of cylindrical configuration and having a co-axial conical projection 53 at each end 54, 55 of the magnetic core 52. In the preferred embodiment shown in FIG. 8, the conical projections 53 are separate metal pieces attached by the force of the magnet's attraction to each end 54, 55 of the cylindrical magnetic core 52 The wheel 51 has a central hub 56 and a circular rim 57 having an inner surface 58 and an outer surface 59. A web 60 radially extends from the hub 56 to connect the hub 56 to the inner surface 58 of rim 57. The magnetic core 52 is inserted into said hub 56 with the conical projections 53 extending co-axially out from the central hub. In the preferred embodiment illustrated in FIG. 5 to 10, the magnetic core 52 with affixed conical projections 53 is first inserted into hubcap 61 which, in turn, is inserted flush into the central hub 56. A rubber coating may be affixed to the outer surface 59 of the rim 57 to facilitate bouncing and increase durability of the wheel. The assembled wheel 51 should be balanced and the conical projections 53 should extend from each side of the wheel 51 so as to contact the rails of the toy and enable simple wheel motion, namely so the shuttle wheel can be rolled back and forth on the rails of the toy.

Other configurations of shuttle wheel can be used with the shuttle wheel toy according to the present invention. The wheel may, for example, comprise a sphere with a channel centrally disposed along the diameter of the sphere. A cylindrical magnetic core may be inserted into the channel having conical protrusions attached at each end of core. The protrusions should extend a sufficient distance from the periphery of sphere to contact the rails and enable simple motion, once the second half of the sphere with similar channel is affixed to complete the wheel.

It is possible in order to give the user a greater sense of control to adapt the rails to attach to a handle that is in the form of a glove. This embodiment is appropriate for use by multiple players where the wheel is passed (thrown) from one player and caught by a second player on the rails of his shuttle wheel toy. Games can be developed with rules similar to lacrosse or hockey whereby the objective is to pass the shuttle wheel and ultimately score a goal by shooting the wheel into a net. The games could be played on ice skates or preferably in-line skates for greater enjoyment.

The following examples set out a few of the wide variety of tricks that can be performed to enhance the playability of the shuttle wheel toys according to the present invention.

The Launches

Front Flip

When the wheel is moving away from the operator and on a path around the front of the bend so as to begin coming back towards the operator a slight jerk of the wrist will launch the wheel in the air where it can be caught and the wheel will continue to roll along the rails uninterrupted.

Ollie

An ollie can only be attempted when the wheel is on the top of the upper rail sections. The ollie pegs are depressed and then released. This motion will propel the wheel up in the air allowing a catch to be made on any side of the rails.

Finger Flip

A finger flip allows for the most control of the wheel. It involves bringing the rail upwards in a motion that will impact with the index finger of the operator's free hand. Note that the wheel must be on the outside of the rails at the time and the finger used remains stationary to allow for maximum height on the launch.

Under Flip

Follow similar instructions for the finger flip but, this trick can only be attempted when the wheel is rolling towards the operator on the grip or side rails. The under flip will propel the wheel up and off the bottom of the rails getting air and allowing for any catch position.

Ollie Grip Flip

To execute this launch one must take the index finger of one's free hand and place it flat across the two V-shaped curves (nubs) on the bottom rail (grip). When the wheel is rolling along the bottom of the grip into the bend the free finger should slide down towards the bend until it is stopped by the bend. Ensure the wheel is coming around the outside of the bend before commencing finger slide and the wheel will be launched up.

Thumbs Up

Take your free hand and give a thumbs up signal. As the position of the wheel gets closer to the point of intended impact (towards the operator on the top of the rail) the thumb must be brought up to hit the wheel and launch it into the air.

Max Launch

This launch is similar to the front flip except the force of the flip is increased and the free hand is used to stop the motion halfway (by hitting one's wrist or forearm). This trick if executed properly can allow for up to 40 feet of air and should not be attempted unless operator is adept at catching.

Rails

Stall

A stall can be done at virtually any point during the wheel's simple motion. Two fingers of the operator's free hand are used to increase the distance between the left and right rails. The distance must be increased far enough so that the wheel will continue to spin but will not move in any direction.

Rail Slide

The distance between the left and right rails should be increased past that used in a stall. The wheel can then be stalled or can continue to sin along either the top or bottom rail exclusively until the operator allows the wheel to go back into its simple motion by decreasing the distance between left and right rails.

Mack

To execute this trick properly the wheel must be rolling away from the operator along the outside of the bottom rails. Right before the wheel enters the bend the left rail is pulled upwards to allow the wheel to spin down towards the operator with the left conical projection (or mag) on the bottom left rail and the right mag on the top right rail. To allow the wheel back into its simple action the operator must wait for the wheel to enter back into the area of the bend and allow the left rail to ease back into its original position adjacent the right rail.

Mack-Out

This move can interrupt the mack by releasing the left rail back to its original position prematurely.

Whack

This move is similar to the Mack in that the wheel rolls down the interior of the rails with the left mag on the bottom left rail and the right mag on the top right rail. It must be done by rail sliding a stall into the desired position.

Whack-Out

This move can interrupt the whack by flicking one's thumb into the right rail to allow the right mag to fall back onto the bottom rail into its simple motion.

Psych

A Pysch can be done when the wheel is rolling towards the operator along the top or bottom rails. The operator must pull the rails apart near the bend with the free hand. This motion will force the wheel to roll exclusively on a small section of the rails until they are allowed to return to their normal position.

Table Tops

Dump

When the wheel is rolling away from the operator along the bottom of the outside rail hitting the side rails onto the table will release the wheel from the rails spinning in a top like motion.

Hurricane Spin

This is the name of a spin once it is out of a dump, it should continue to spin for at least 30 seconds in a fixed area.

Boomerang

This is a hurricane spin that once dumped onto the table, spins away from and then back onto the rails. It must be dumped before the wheel starts around the bend.

Sky Dump

By touching a rail the top mag of a hurricane spin it can be raised up off the table. One can then drop the wheel back into a hurricane by hitting the rails up and away from the wheel allowing it to fall back onto the table.

Around the World

Once the wheel is in a hurricane spin it must be picked up by touching the top mag to a nub on the rail. The wheel must then be slid around on the one rail around the bend up along the rail to the ollie pegs where it will fall back onto the table still in a spin.

Back

Once completing around the world the wheel must be picked up by the opposite nub then the process is repeated.

Indian Flip

Pick the top mag of the wheel out of a hurricane spin and throw it up into the air. If it is thrown correctly it can be caught without interrupting the simple motion.

Tranny

Pick the top mag of the wheel out of a hurricane spin and slide it down towards the ollie pegs. A twist of the wrist will swing the rail around so that the free mag will connect with the unused rail and simple motion will resume.

Rail Airs

360° Rail

This move involves throwing the entire rail with the wheel still attached in a three sixty and catching it without interrupting the simple motion of the wheel.

720° Rail

This move is similar to the 360° rail except the rail is thrown in a seven twenty and caught without interrupting the simple motion.

Other tricks varying in difficulty that can be performed include: Highland Crab, Senpuken, Reppuken, IRS Ollie, Grip Suicide, Spit Rail Grip Suicide, Floor Bounce, Table Bounce, Wall Bounce, Ceiling Bounce, Forehead Fandango, B.T. (Bent Twirl), Side Ride, Kamikaze 360, Kamikaze Table Top, Dark Side, Quickie, Zero Gravity, Bottom's Up, Rail Bounce, No Look, Under the Leg, Funny Bone, Short Cut, Kickback, Handcuff, Yo-Yo, Reverse 360, 1080 Rail, RailaAir 360, Sitch Hand Senpuken, Faerie, Fakie, Blocker, Crazy Little Fly, Quad Bounce, Rever, Ollie Split Rail, 360 Twist, Reverse Twist, Lobotomy, Rail Suicide, Switch Hand 360, Switch Hand 720, Switch Hand 1080 and Ollie Grip Bent Twirl (O.G.B.T.).

Having illustrated and described a preferred embodiment of the invention and certain possible modifications thereto, it should be apparent to those of ordinary skill in the art that the invention permits of further modification in arrangement and detail. For example various different rail configurations can be developed to provide different patterns of motion and enable different tricks to be performed. All such modifications are covered by the scope of the invention.

The embodiments of the invention in which an exclusive property or privilege is claimed are defined as follows:

1. A hand held shuttle wheel toy having parallel metal rails on which a shuttle wheel can be rolled back and forth, said toy comprising:

(a) a first pair of parallel metal rails, each of said rails having a top and bottom side, a fixed end and at least one free end;

(b) a handle into which the fixed end of said first pair of parallel rails is inserted;

(c) a shuttle wheel having a magnetic core, a conical projection at each end of the magnetic core, a central hub wherein said core is inserted into said central hub with the conical projections extending co-axially out from said central hub and a circular rim having an inner surface and an outer surface;

(d) each of said first pair of parallel rails, adjacent said handle, having a bend section displaced laterally and outwardly from the longitudinal axis of each of said first pair of parallel rails to permit said shuttle wheel to roll along either the top or bottom side of each of said first pair of parallel rails and then reverse direction on the other side of each of said first pair of parallel rails and the free end of each of said first pair of parallel rails is bent outwardly from the longitudinal axis of each of said first pair of parallel rails;

(e) a second pair of parallel metal rails, each of said rails having a top and bottom side, a first end fixed within said handle, a first section extending upwards from the first end fixed within said handle, said first section connected to an inclined section extending from said first section upwards and rearwardly above said handle and a second end remote from said handle and bent outwardly from the longitudinal axis of said second pair of parallel rails; and (f) each of said second pair of parallel rails, having in said inclined section adjacent said first section, a bend section displaced laterally and outwardly from the longitudinal axis of each of said second pair of parallel rails to permit said shuttle wheel to roll along either the top or bottom side of each of said second pair of parallel rails and then reverse direction on the other side of each of said second pair of parallel rails.

2. A toy according to claim 1 wherein said first pair of parallel metal rails are U-shaped.

3. A toy according to claim 1 or 2 wherein a hole is provided in said handle at the end remote from the first and second pair of parallel rails, said hole permitting a variety of unique and different tricks to be performed.

4. A toy according to claim 1 wherein the second end of said second pair of parallel rails is welded to the fixed end of said first pair of parallel rails and inserted into said handle.

5. A toy according to claim 1 wherein the second end of said second pair of rails are joined together in a loop.

6. A toy according to claim 1 wherein said handle is adapted to connect to a glove to be worn on a players hand and said shuttle wheel is in the shape of a sphere.

* * * * *